US009857055B2

(12) United States Patent
Hu et al.

(10) Patent No.: US 9,857,055 B2
(45) Date of Patent: Jan. 2, 2018

(54) LED MODULE AND LENS MOUNTED THEREON

(71) Applicant: HON HAI PRECISION INDUSTRY CO., LTD., New Taipei (TW)

(72) Inventors: Chau-Jin Hu, New Taipei (TW); Feng-Yuen Dai, New Taipei (TW); Po-Chou Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 298 days.

(21) Appl. No.: 14/667,671

(22) Filed: Mar. 24, 2015

(65) Prior Publication Data

US 2015/0276179 A1 Oct. 1, 2015

(30) Foreign Application Priority Data

Mar. 26, 2014 (TW) ..... 103111343 A

(51) Int. Cl.

| | |
|---|---|
| ***F21V 7/00*** | (2006.01) |
| ***F21V 5/04*** | (2006.01) |
| *F21Y 115/10* | (2016.01) |

(52) U.S. Cl.
CPC ..... *F21V 5/046* (2013.01); *F21V 7/0025* (2013.01); *F21Y 2115/10* (2016.08)

(58) Field of Classification Search
CPC ..... F21V 5/046; F21V 7/0025; F21Y 2115/10
USPC ..... 362/305, 327, 311.02, 329
See application file for complete search history.

(56) References Cited

U.S. PATENT DOCUMENTS

| | | | | |
|---|---|---|---|---|
| 7,549,769 | B2 * | 6/2009 | Kim | F21V 5/04 362/241 |
| 2016/0131330 | A1 * | 5/2016 | Jiang | F21K 9/233 362/235 |

* cited by examiner

*Primary Examiner* — Elmito Breval
*Assistant Examiner* — Jessica M Apenteng
(74) *Attorney, Agent, or Firm* — Steven Reiss

(57) ABSTRACT

A lens has a plurality of first, second, and third optical regions. The first, second and third optical regions are arranged in sequential order. Space angle defined between each first, second, and third optical region and an optical axis of the lens are different from each other. Each first, second and third optical region includes a refracting surface and a reflecting surface which are arranged in different planes. The invention also relates to an LED module having the lens described above.

16 Claims, 7 Drawing Sheets

LED MODULE AND LENS MOUNTED THEREON

CROSS-REFERENCE TO RELATED APPLICATIONS

This application claims priority to Taiwan Patent Application No. 103111343 filed on Mar. 26, 2014, the contents of which are incorporated by reference herein.

FIELD

The subject matter herein generally relates to an LED module and a lens mounted on the LED module.

BACKGROUND

Generally, a light emitting diode (LED) includes an LED chip and an encapsulating layer covering the LED chip. Most of the light from the LED chip gathers around an optical axis of the LED chip. The light distributed near a periphery of the LED is weak. So the LED has a narrow light emitting angles.

BRIEF DESCRIPTION OF THE DRAWINGS

Implementations of the present technology will now be described, by way of example only, with reference to the attached figures.

DETAILED DESCRIPTION OF EMBODIMENTS

It will be appreciated that for simplicity and clarity of illustration, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure. The description is not to be considered as limiting the scope of the embodiments described herein.

Several definitions that apply throughout this disclosure will now be presented. The term "comprising" means "including, but not necessarily limited to"; it specifically indicates open-ended inclusion or membership in a so-described combination, group, series and the like. The term "coupled" is defined as connected, whether directly or indirectly through intervening components, and is not necessarily limited to physical connections. The connection can be such that the objects are permanently connected or releasably connected. The term "electronically coupled" can include any coupling that is via a wired or wireless connection. The electronic coupling can be through one or more components or it can include a direct connection between the described components.

Figure 1:
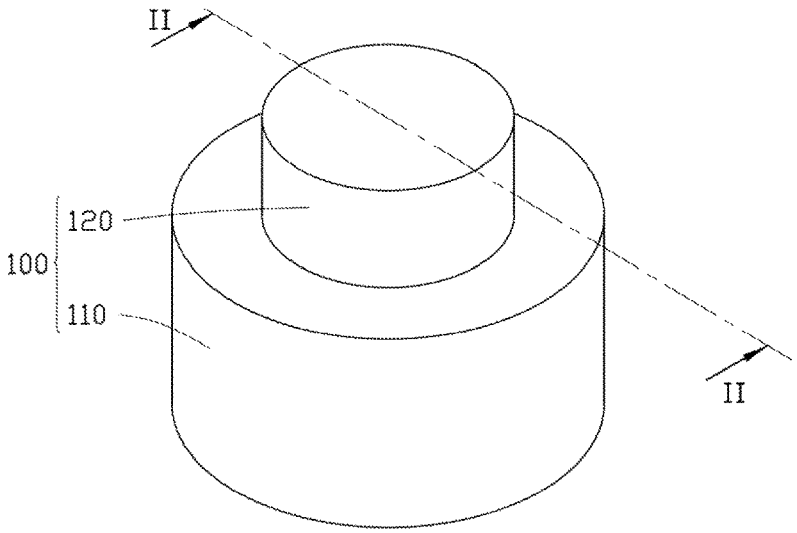
FIG. 1 is an isometric view of an LED module of a first embodiment of the present disclosure.
Figure 2:
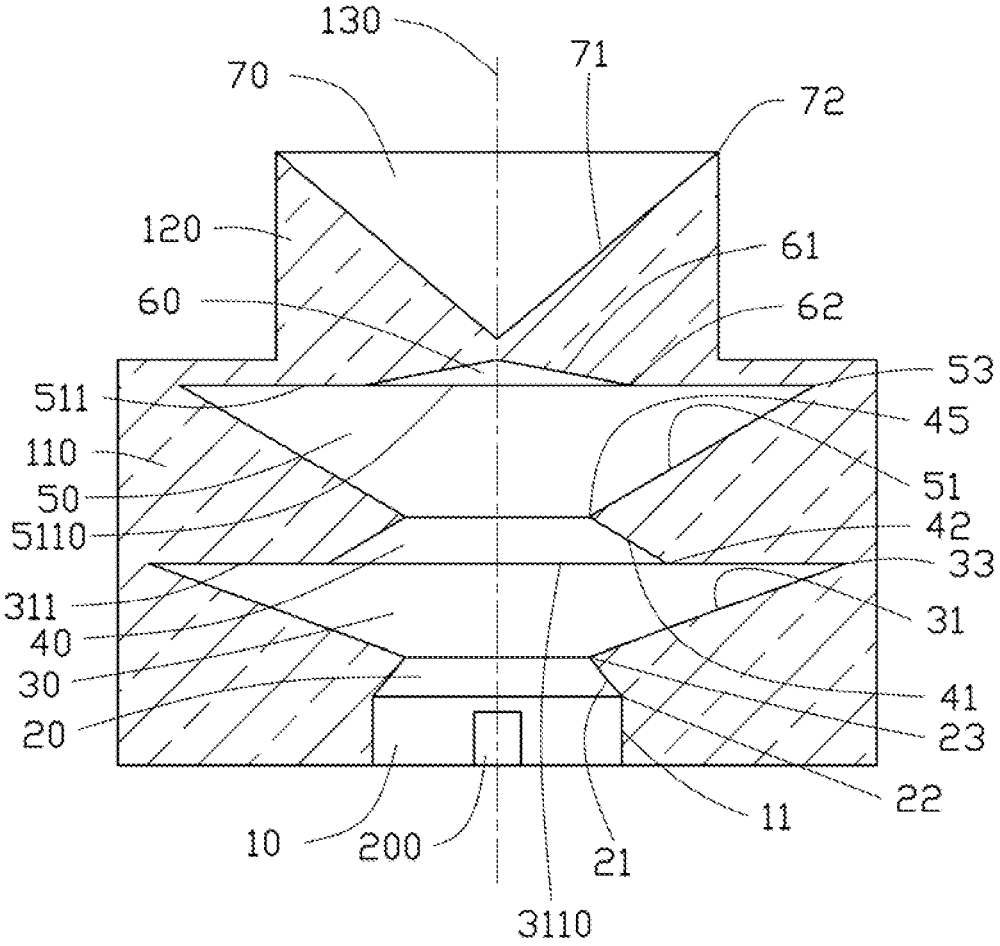
FIG. 2 is a cross section view of the LED module of FIG. 1, taken along II-II line thereof.

Referring to FIGS. 1-2, a LED module of a first embodiment includes a LED chip 200 and a lens 100 cooperating with the LED chip 200.

The lens 100 includes a main portion 110 and an extending portion 120 protruding from a top surface of the main portion 110. The main portion 110 and the extending portion 120 are coaxial. Each of the main portion 110 and the extending portion 120 is a cylinder. A diameter of the main portion 110 is greater than the diameter of the extending portion 120.

The lens 100 has an optical axis 130 at a radial center thereof. A first cavity 10, a second cavity 20, a third cavity 30, a fourth cavity 40, a fifth cavity 50 and a sixth cavity 60 are defined in the main portion 110 of the lens 100 in series spanning from the bottom to the top of the main portion 110 of the lens 100. A seventh cavity 70 is defined in the extending portion 120. The first cavity 10, the second cavity 20, the third cavity 30, the fourth cavity 40, the fifth cavity 50, the sixth cavity 60 and the seventh cavity 70 are rotational symmetric about the optical axis 130.

The first cavity 10 has a cylindrical-shape and is bounded by a vertical side wall 11. A diametric cross section of the first cavity 10 is rectangular. A placing point intersecting with the optical axis and a bottom of the lens 100 is defined. The LED chip 200 is positioned at the placing point.

The second cavity 20 is frusto-conical. The diametric cross section of the second cavity 20 has a trapezoidal-shape. The second cavity 20 extends from a top end of the vertical side wall 11 of the first cavity 10. A diameter of the second cavity 20 decreases from a bottom end connected with the first cavity 10, towards a top end of the second cavity 20. The diameter of the bottom end of the second cavity 20 is equal to the diameter of the first cavity 10. The second cavity 20 is defined by a first refracting surface 21. The first refracting surface 21 and the vertical side wall 11 intersect to form a circular edge shown in diametric cross section of the lens 100 to form first intersection points 22. The first intersection points 22 are symmetrical about the optical axis 130 in the diametric cross section of the lens 100.

The third cavity 30 is frusto-conical, and a diametric cross section of the third cavity 30 has a trapezoidal-shape. The third cavity 30 extends from a top end of the first refracting surface 21. A diameter of the third cavity 30 increases from a bottom end of the third cavity 30, connected with the second cavity 20, towards a top end of the third cavity 30. The diameter of the bottom end of the cavity 30 is equal to the diameter of the top end of the second cavity 20. The third cavity 30 is defined by a first reflecting surface 31 and a first connecting surface 311. The first reflecting surface 31 extends upwards and outwards from the top end of the first refracting surface 21. The first connecting surface 311 extends horizontally from a top end of the first reflecting surface 31 towards the optical axis 130. The first connecting surface 311 is toroidal having a first opening 3110 at a center. The first reflecting surface 31 and the first refracting surface 21 intersect to form a circular edge shown in diametric cross section of the lens 100, to form second intersection points 23. The second intersection points 23 are symmetrical about the optical axis 130 in the diametric cross section of the lens 100. The first reflecting surface 31 and the first connecting surface 311 intersect to form a circular edge shown in diametric cross section of the lens 100 to form third intersection points 33. The third intersection points 33 are symmetrical about the optical axis 130 in the diametric cross section of the lens 100.

The fourth cavity 40 is frusto-conical, and the diametric cross section of the fourth cavity 40 has a trapezoidal-shape. The fourth cavity 40 extends from edges of the first opening 3110 of the first connecting surface 311. A diameter of the fourth cavity 40 decreases from a bottom end of the fourth cavity 40, connected with the third cavity 30, towards a top end of the fourth cavity 40. The diameter of the bottom end of the fourth cavity 40 is equal to the diameter of the opening 3110 of the first connecting surface 311. The fourth cavity 40 is defined by a second refracting surface 41. The second refracting surface 41 and the first connecting surface 311 intersect to form a circular edge shown in diametric cross section of the lens 100 to form fourth intersection points 42. The fourth intersection points 42 are symmetrical about the optical axis 130 in the diametric cross section of the lens 100. The second refracting surface 41 is above of the first reflecting surface 31.

The fifth cavity 50 is frusto-conical, and a diametric cross section of the fifth cavity 50 has a trapezoidal-shape. The fifth cavity 50 extends from a top end of the second refracting surface 41. A diameter of the fifth cavity 50 increases from a bottom end of the fifth cavity 50, connected with the fourth cavity 40, towards a top end of the fifth cavity 50. The diameter of the bottom end of the fifth cavity 50 is equal to the diameter of the top end of the fourth cavity 40. The fifth cavity 50 is defined by a second reflecting surface 51 and a second connecting surface 511. The second reflecting surface 51 extends upwards and outwards from the top end of the second refracting surface 41, and the second connecting surface 511 extends horizontally from the top end of the second reflecting surface 51 towards the optical axis 130. The second connecting surface 511 is toroidal having a second opening 5110 at a center. The second reflecting surface 51 and the second refracting surface 41 intersect to form a circular edge shown in diametric cross section of the lens 100 to form fifth intersection points 45. The fifth intersection points 45 are symmetrical about the optical axis 130 in the diametric cross section of the lens 100. The second refracting surface 51 and the second connecting surface 511 intersect to form a circular edge shown in diametric cross section of the lens 100 to form sixth intersection points 53. The sixth intersection points 53 are symmetrical about the optical axis 130 in the diametric cross section of the lens 100.

The sixth cavity 60 is conical-shape, and a diametric cross section of the sixth cavity 60 is triangular. The sixth cavity 60 extends from edges of the second opening 5110 of the second connecting surface 511. An apex of the sixth cavity 60 lies along the optical axis 130. A diameter of the sixth cavity 60 decreases from a bottom end of the sixth cavity 60, connected with the fifth cavity 50, towards a top end of the sixth cavity 60. The diameter of the bottom end of the sixth cavity 60 is equal to the diameter of the second opening 5110 of the second connecting surface 511. The sixth cavity 60 is defined by a third refracting surface 61. The third refracting surface 61 and the second connecting surface 511 intersect to form a circular edge shown in diametric cross section of the lens 100 to form seventh intersection points 62. The seventh intersection points 62 are symmetrical about the optical axis 130 in the diametric cross section of the lens 100. The third refracting surface 61 is above of the second reflecting surface 51.

The seventh cavity 70 is conically-shaped, and a diametric cross section of the seventh cavity 70 is triangular. The seventh cavity 70 extends from a top end of the extending portion 120. The apex of the seventh cavity 70 lies along the optical axis 130. A diameter of the seventh cavity 70 decreases from a top end of the seventh cavity 70 connected with edges of the extending portion 120, towards the first cavity 10. The diameter of the top end of the seventh cavity 70 is equal to the diameter of the extending portion 120. The seventh cavity 70 is defined by a third reflecting surface 71. The top end of the third reflecting surface 71 and edges of the extending portion 120 intersect to form a circular edge shown in diametric cross section of the lens 100 to form eighth intersection points 72. The eighth intersection points 72 are symmetrical about the optical axis 130 in the diametric cross section of the lens 100.

Figure 3:
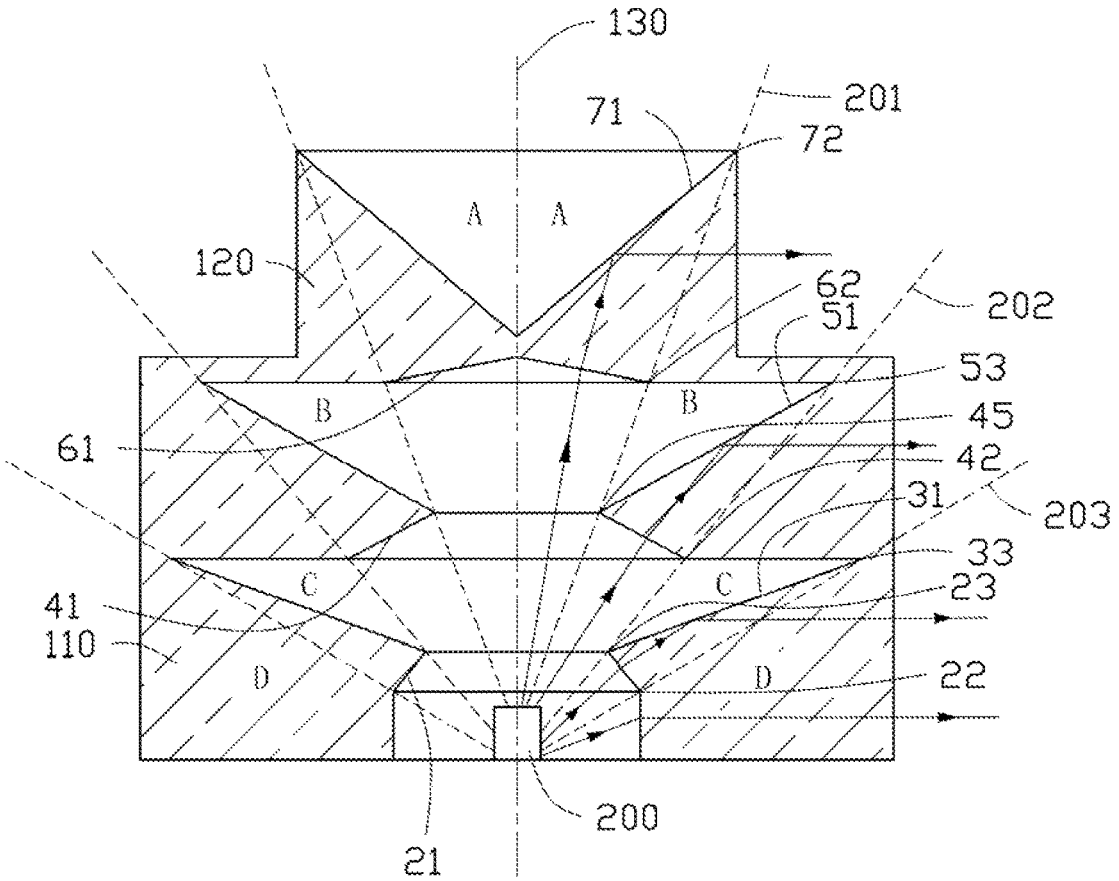
FIG. 3 is a light path diagram of the LED module.

As shown in FIG. 3, a side of the diametric cross section of the lens 100, the eighth intersection points 72, the seventh intersection points 62, the fifth intersection points 45 cooperatively define an imaginary first line 201; the sixth intersection points 53, the fourth intersection points 42 and the second intersection points 23 cooperatively define an imaginary second line 202; the third intersection points 33, the first intersection points 22 and the LED chip 200 cooperatively define an imaginary third line 203. An angle defined between the third line 203 and the optical axis 130 is 60°.

As shown in FIG. 3, lens 100 also defines a plurality of first, second and third optical regions A, B, and C arranged from the top of the lens 100 towards the bottom of the lens 100. The imaginary first line 201 projects around the optical axis 130 to form a first conical area. The first conical area located in the lens 100 defines the optical region A. The imaginary second line 202 projects around the optical axis 130 to form a second conical area. The optical region B is defined between the second conical area and the first conical area located in the lens 100. The third imaginary line 203 projects around the optical axis 130 to form a third conical area. The optical region C is defined between the third conical area and the second conical area located in the lens 100.

The lens 100 further includes a fourth optical region D located adjacent the optical region C. The third line 203 projects around the optical axis 130 to form a fourth conical area. The optical region D is defined between the fourth conical area located in the lens 100 and the bottom surface of the lens 100. Light emitting angles of the LED chip 200 defined in the third refracting surface 61, the second refracting surface 41, the first refracting surface 21 and the optical axis 130 are different. Particularly, light emitting angles defined between the third refracting surface 61 and the optical axis 130 are larger than light emitting angles defined between the second refracting surface 41 and the optical axis 130; Light emitting angles defined between the second refracting surface 41 and the optical axis 130 are larger than light emitting angles defined between the first refracting surface 21 and the optical axis 130. Light emitting angles defined between the third reflecting surface 71, the second reflecting surface 51, the first reflecting surface 31 and the optical axis 130 are also different. Light emitting angles defined between the first reflecting surface 31 and the optical axis 130 are larger than light emitting angles defined between the second reflecting surface 51 and the optical axis 130; light emitting angles defined between the second reflecting surface 51 and the optical axis 130 are larger than light emitting angles defined between the third reflecting surface 71 and the optical axis 130.

Light emitted from the LED chip 200 is reflected and refracted by the reflecting surfaces and the refracting surfaces in the lens 100. Part of emitted light having a radiating angle larger than the 60° relative to the optical axis 130, the light enters the optical region D and is refracted by the vertical side wall 11 to exit from peripheral portions of the lens 100. Part of emitted light having a radiating angle less than the 60° relative to the optical axis 130, the light enters the optical region A, B and C. When emitted light enters the optical region A, the light is refracted by the third refracting surface 61 and reflected by the third reflecting surface 71 to exit from peripheral portions of the lens 100. When emitted light enters the optical region B, the light is refracted by the second refracting surface 41 and reflected by the second surface 51 to exit from peripheral portions of the lens 100. When emitted light enters the optical region C, the light is refracted by the first refracting surface 21 and reflected by the first reflecting surface 31 to exit from peripheral portion of the lens 100.

In the present disclosure, the light emitted by the LED chip 200 enters the optical region A, B, C and D. The original light paths of the light are changed by the refracting surface and the reflecting surface in optical region A, B, C and D to exit toward the peripheral portion of the lens 100. So the emitted light from the lens 100 has a winder light emitted angle and the light intensity of the peripheral portion of the lens is enhanced.

Figure 4:
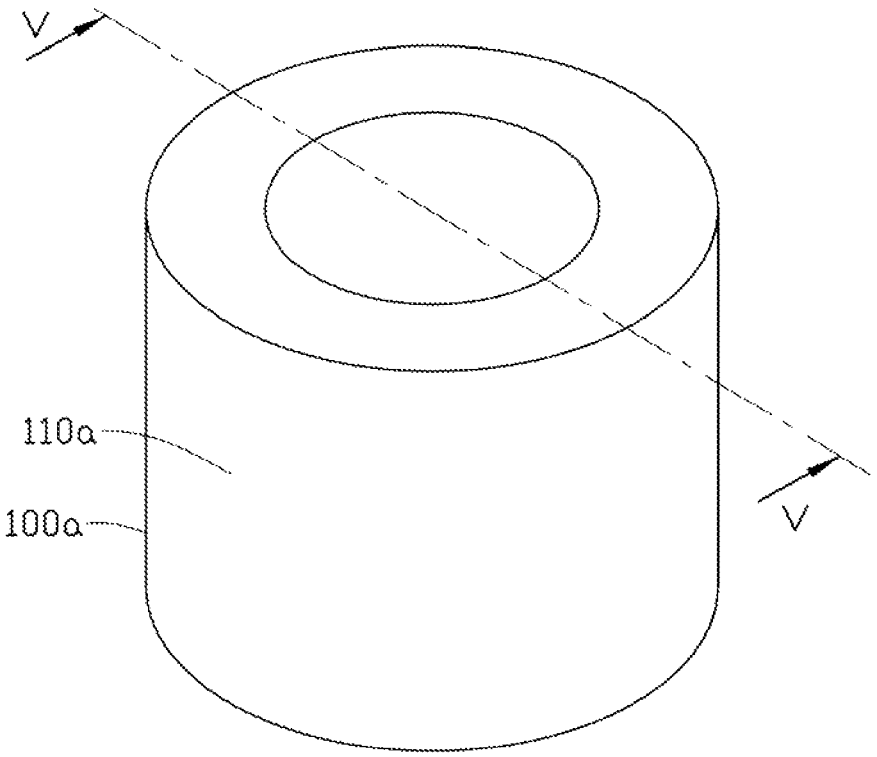
FIG. 4 is an isometric view of an LED module of a second embodiment of the present disclosure.
Figure 5:
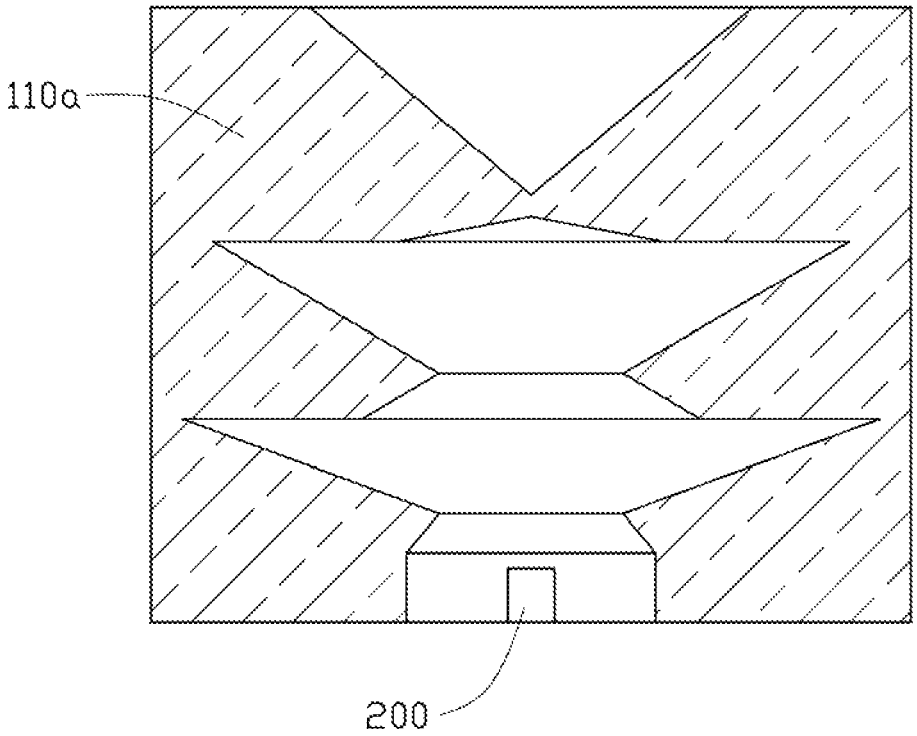
FIG. 5 is a cross section view of the LED module of FIG. 4, taken along V-V line thereof.

Referring to FIGS. 4-5, an LED module of a second embodiment is similar with the LED module of the first embodiment. However, the lens 100*a* of the second embodiment includes only a main portion 110*a*. An isometric view of the LED module is a single cylinder.

Figure 6:
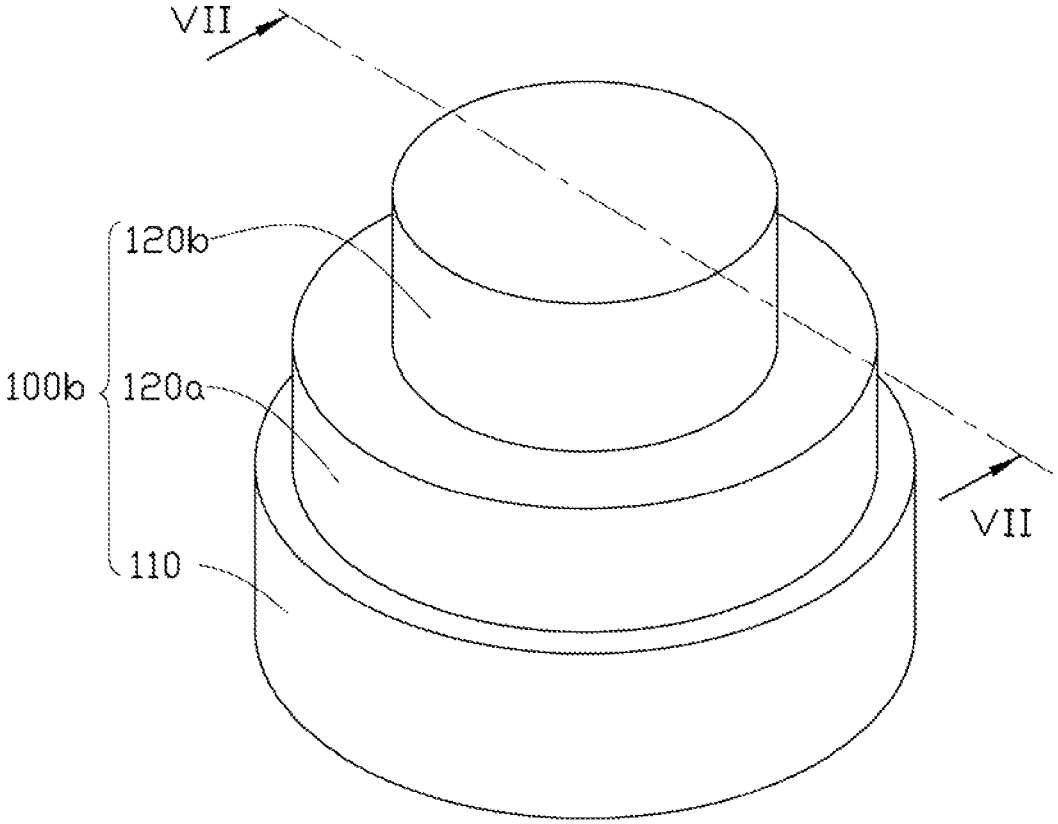
FIG. 6 is an isometric view of an LED module of a third embodiment of the present disclosure.
Figure 7:
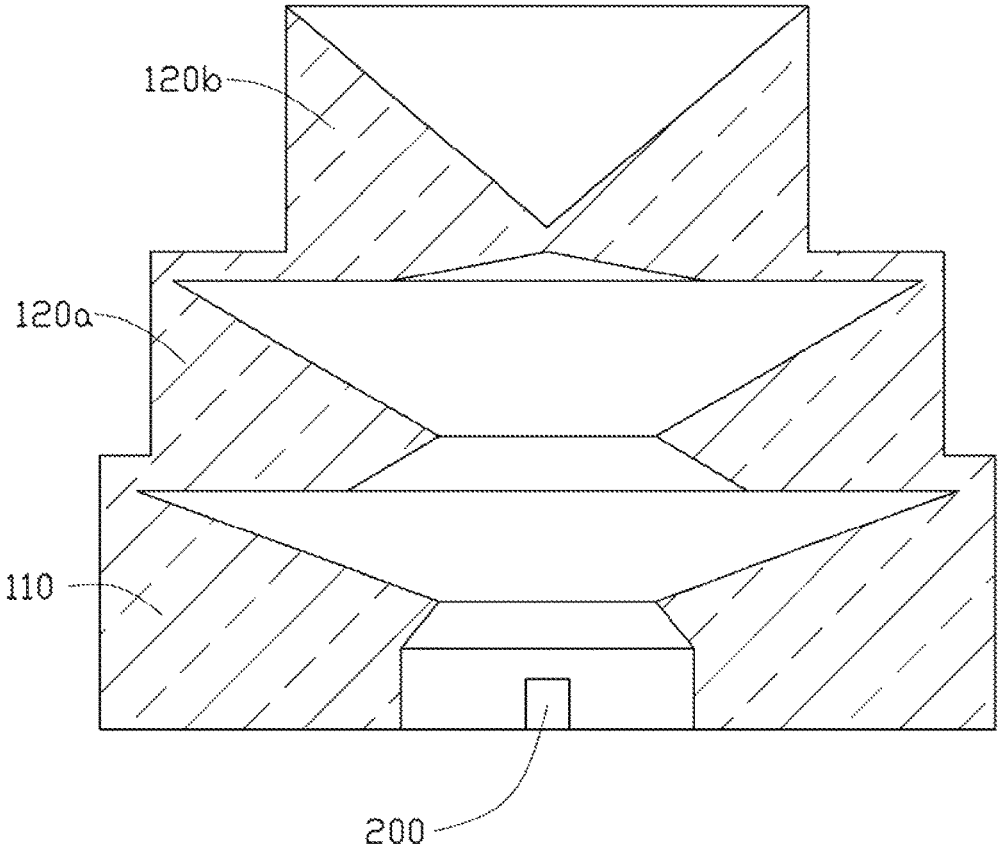
FIG. 7 is a cross section view of the LED module of FIG. 6, taken along VII-VII line thereof.

FIGS. 6-7 illustrate an LED module of a third embodiment. A lens 100*b* of the third embodiment is similar with the lens 100 of the first embodiment. A lens 100*b* includes a main portion 110*b*, a first extending portion 120*a* extends from a top end of the main portion 110*b*, and a second extending portion 120*b* extends from a top end of the first extending portion 120*a*. The diameter of the main portion 110*b* is larger than the diameter of the first extending portion 120*a*, and the diameter of the first extending portion 120*a* is larger than the diameter of the second extending portion 120*b*.

The embodiments shown and described above are only examples. Many details are often found in the art such as the other features of an LED module and lens mounted thereon. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A lens, comprising:

an optical axis at a radial center of the lens;

a placing point intersecting with the optical axis and a bottom of the lens;

first, second, and third, optical regions defined in the lens;

wherein an angle defined between the optical axis and an imaginary line defined between the placing point and a point within the second optical region is larger than an angle defined between the optical axis and an imaginary line defined between the placing point and a point within the first optical region;

wherein an angle defined between the optical axis and an imaginary line defined between the placing point and a point within the third optical region is larger than an angle defined between the placing point and the imaginary line defined between the placing point and the point within the second optical region;

wherein the first, second, and third optical region each have both reflecting surfaces and refracting surfaces cooperating with the reflecting surfaces;

wherein the lens includes a first cavity, a second cavity, a third cavity, a fourth cavity, a fifth cavity, a sixth cavity and a seventh cavity in series spanning from a bottom to a top of the lens;

wherein the first cavity includes a vertical side wall, the second cavity includes a first refracting surface, the third cavity includes a first reflecting surface, the fourth cavity includes a second refracting surface, the fifth cavity includes a second reflecting surface, the sixth cavity includes a third refracting surface, the seventh cavity includes a third reflecting surface.

2. The lens of claim 1, wherein an angle defined between the optical axis and the reflecting surface of the first optical region is larger than an angle defined between the optical axis and the reflecting surface of the second optical region, the angle defined between the optical axis and the reflecting surface of the second optical region is larger than an angle defined between the optical axis and the reflecting surface of the third optical region.

3. The lens of claim 1, wherein an angle defined between the optical axis and the refracting surface of the third optical region is larger than an angle defined between the optical axis and the refracting surface of the second optical region, the angle defined between the optical axis and the refracting surface of the second optical region is larger than an angle defined between the optical axis and the refracting surface of the first optical region.

4. The lens of claim 1, further comprising a fourth optical region, the fourth optical region is defined between the bottom of the lens and an outer edge of the third optical region, the fourth optical region located adjacently the third optical region.

5. The lens of claim 1, wherein an apex of the sixth cavity lies along the optical axis, the apex of the seventh cavity lies along the optical axis.

6. The lens of claim 1, wherein the first refracting surface and the first reflecting surface are located in the first optical region, the second refracting surface and the second reflecting surface are located in the second optical region, the third refracting surface and the third reflecting surface are located in the first optical region.

7. The lens of claim 1, further comprising a first connecting surface and a second connecting surface, the first connecting surface connects with the first reflecting surface and the second refracting surface, the second connecting surface connects with the second reflecting surface and the third refracting surface.

8. The lens of claim 7, wherein the first refracting surface and the vertical side wall intersect to form a circular edge shown in diametric section of the lens to form first intersection points; the first reflecting surface and the first refracting surface intersect to form a circular edge shown in diametric cross section of the lens to form second intersection points; the first reflecting surface and the first connecting surface intersect to form a circular edge shown in diametric cross section of the lens to form third intersection points; the second refracting surface and the first connecting surface intersect to form a circular edge shown in diametric cross section of the lens to form fourth intersection points; the second reflecting surface and the second refracting surface intersect to form circular edge shown in diametric cross section of the lens to form fifth intersection points; the second refracting surface and the second connecting surface intersect to form a circular edge shown in diametric cross section of the lens to form sixth intersection points; the third refracting surface and the second connecting surface intersect to form a circular edge shown in diametric cross section of the lens to form seventh intersection points; the top end of the third reflecting surface and edges of the top end of the lens intersect to form a circular edge shown in diametric cross section of the lens to form eighth intersection points.

9. The lens of claim 8, wherein the first intersection points are symmetrical about the optical axis in the diametric cross section of the lens; the second intersection points are symmetrical about the optical axis in the diametric cross section of the lens; the third intersection points are symmetrical about the optical axis in the diametric cross section of the lens; the fourth intersection points are symmetrical about the optical axis in the diametric cross section of the lens; the fifth intersection points are symmetrical about the optical axis in the diametric cross section of the lens; the sixth intersection points are symmetrical about the optical axis in the diametric cross section of the lens; the seventh intersection points are symmetrical about the optical axis in the diametric cross section of the lens; the eighth intersection points are symmetrical about the optical axis in the diametric cross section of the lens.

10. The lens of claim 9, wherein at a side of the diametric cross section of the lens, the eighth intersection points, the seventh intersection points, the fifth intersection points cooperatively define an imaginary first line; the sixth intersection points, the fourth intersection points and the second intersection points cooperatively define an imaginary second line; the third points, the first intersection points and the placing point cooperatively define an imaginary third line.

11. The lens of claim 1, wherein the first cavity, the second cavity, the third cavity, the fourth cavity, the fifth cavity, the sixth cavity and the seventh cavity are rotational symmetric about the optical axis.

12. The lens of claim 1, wherein a diametric cross section of the first cavity is rectangular, a diametric cross section of the second cavity, the third cavity, the fourth cavity and a fifth cavity have trapezoidal-shapes, a diametric cross section of the sixth cavity and the seventh cavity are triangular.

13. An LED module comprising:

a lens;

an optical axis at a radial center of the lens;

a placing point intersecting with the optical axis and a bottom of the lens;

an LED chip located at the placing point;

first, second, and third optical regions defined in the lens;

wherein an angle defined between the optical axis and an imaginary line defined between the placing point and a point within the second optical region is larger than an angle defined between the optical axis and an imaginary line defined between the placing point and a point within the first optical region;

wherein an angle defined between the optical axis and an imaginary line defined between the placing point and a point within the third optical region is larger than an angle defined between the placing point and the imaginary line defined between the placing point and the point within the second optical region;

wherein the first, second, and third optical region each have both reflecting surfaces and refracting surfaces cooperating with the reflecting surfaces;

wherein the light emitted from the LED chip enters the first, the second, and the third optical region and is refracted and reflected to exit from edges of the lens;

wherein the lens includes a first cavity, a second cavity, a third cavity, a fourth cavity, a fifth cavity, a sixth cavity and a seventh cavity in series spanning from the bottom to the top;

wherein the first cavity includes a vertical side wall, the second cavity includes a first refracting surface, the third cavity includes a first reflecting surface, the fourth cavity includes a second refracting surface, the fifth cavity includes a second reflecting surface, the sixth cavity includes a third refracting surface, the seventh cavity includes a third reflecting surface.

14. The LED module of claim 13, wherein an angle defined between the optical axis and the reflecting surface of the first optical region is larger than an angle defined between the optical axis and the reflecting surface of the second optical region, the angle defined between the optical axis and the reflecting surface of the second optical region is larger than an angle defined between the optical axis and the reflecting surface of the third optical region.

15. The LED module of claim 13, wherein an angle defined between the optical axis and the refracting surface of the third optical region is larger than an angle between the optical axis and the refracting surface of the second optical region; an angle between the optical axis and the refracting surface of the second optical region is larger than an angle defined between the optical axis and the refracting surface of the first optical region.

16. The LED module of claim 13, further comprising a fourth optical region, the fourth optical region is defined between a bottom of the lens and an outer edge of the third optical region, the fourth optical region located adjacently the third optical region.

* * * * *